US008557062B2

(12) United States Patent
Reichlinger et al.

(10) Patent No.: US 8,557,062 B2
(45) Date of Patent: Oct. 15, 2013

(54) ALUMINUM ZINC MAGNESIUM SILVER ALLOY

(75) Inventors: Burke L. Reichlinger, Kent, WA (US); Brien J. McElroy, North Bend, WA (US); Iulian Gheorghe, Canton, GA (US)

(73) Assignee: The Boeing Company, Chicago, IL (US)

( * ) Notice: Subject to any disclaimer, the term of this patent is extended or adjusted under 35 U.S.C. 154(b) by 261 days.

(21) Appl. No.: 12/013,742

(22) Filed: Jan. 14, 2008

(65) Prior Publication Data

US 2009/0180920 A1 Jul. 16, 2009

(51) Int. Cl.
*C22F 1/053* (2006.01)
*C22C 21/10* (2006.01)

(52) U.S. Cl.
USPC ..... 148/523; 420/532

(58) Field of Classification Search
USPC ..... 420/530; 148/523
See application file for complete search history.

(56) References Cited

U.S. PATENT DOCUMENTS 4,305,763 A 12/1981 Quist et al.
7,214,281 B2 * 5/2007 Gheorghe et al. ..... 148/550

FOREIGN PATENT DOCUMENTS

| | | |
|---|---|---|
| EP | 0 670 377 | 9/1995 |
| WO | WO 2006/083982 | 8/2006 |
| WO | WO 2008/003504 | 1/2008 |
| WO | WO 2008/003506 | 1/2008 |

* cited by examiner

*Primary Examiner* — Jie Yang
(74) *Attorney, Agent, or Firm* — Haynes and Boone, LLP

(57) ABSTRACT

A copper-free wrought aluminum alloy product and method for producing the same are provided. In one example, the alloy has a composition of about 0.01 to about 1.5 weight percent silver; about 1.0 to about 3.0 weight percent magnesium; about 4.0 to about 10.0 weight percent zinc; about 0.05 to about 0.25 weight percent zirconium; a maximum of 0.15 weight percent iron; a maximum of 0.15 weight percent silicon; and a remainder including aluminum, incidental elements, and impurities. In one example, the alloy may be used to manufacture structural elements for aircraft.

5 Claims, 8 Drawing Sheets

ALUMINUM ZINC MAGNESIUM SILVER ALLOY

TECHNICAL FIELD

The present invention relates generally to metal alloys and, more particularly, to aluminum-zinc-magnesium alloys and methods of making the same.

BACKGROUND

Various metals are utilized in building aircraft and increasingly alloys are being developed for desirable mechanical and physical properties.

Titanium alloys are seeing increased usage in aircraft structures particularly where high strength and anti-corrosion performance is required. However such alloys are expensive. Aluminum-lithium alloys show promise as alternative titanium alloys but they are difficult to make, costly, and have relatively low conductivity when compared to the traditional, non-lithium containing aluminum alloys. Traditional aluminum alloys have been researched but have not provided the desirable balance of properties for aircraft use until the present invention.

Thus, there is a need for high strength and high conductivity aluminum alloys that also have fracture toughness, corrosion resistance, and compatibility with carbon fiber composites as well as other desirable properties.

SUMMARY

Advantageous alloys with improved strength, fracture toughness, and exfoliation corrosion rating of EA or better in peak strength temper, high conductivity, and good galvanic corrosion behavior when attached to a carbon fiber composite member are disclosed. Methods of making the same are also disclosed herein.

In accordance with one embodiment of the present invention, an alloy is provided, the alloy comprising about 0.01 to about 1.5 weight percent silver, about 1.0 to about 3.0 weight percent magnesium, about 4 to about 10 weight percent zinc, and more than about 80 weight percent aluminum and incidental elements.

In accordance with another embodiment of the present invention, an alloy is provided, the alloy comprising about 1.0 to about 3.0 weight percent magnesium, about 4 to about 10 weight percent zinc, more than about 80 weight percent aluminum and incidental elements; and no copper.

In accordance with another embodiment of the present invention, an alloy is provided, the alloy comprising about 1.0 to about 3.0 weight percent magnesium, about 4 to about 10 weight percent zinc, about 0.01 to about 0.25 weight percent zirconium, about 0.01 to about 0.25 weight percent titanium, about 0.01 to about 0.25 weight percent scandium, about 0.01 to about 0.25 weight percent strontium, more than about 80 weight percent aluminum and incidental elements; and no copper.

In accordance with another embodiment of the present invention, an alloy is provided, the alloy comprising about 0.01 to about 1.5 weight percent silver; about 1.0 to about 3.0 weight percent magnesium; about 4.0 to about 10.0 weight percent zinc; about 0.05 to 0.25 weight percent zirconium; a maximum of 0.15 weight percent iron; a maximum of 0.15 weight percent silicon; and a remainder including aluminum, incidental elements, and impurities.

The alloy as described above may be comprised of about 6.5 to about 9.5 weight percent zinc, about 4.0 to about 6.5 weight percent zinc, or about 7.4 to about 10 weight percent zinc, in one example.

The alloy as described above may further comprise about 0.05 to about 0.25 weight percent chromium, about 0.01 to about 0.8 weight percent manganese, about 0.01 to about 0.25 weight percent strontium, and/or about 0.01 to about 0.25 weight percent scandium, in one example.

The alloy as described above may further comprise incidental copper content of below 0.05 weight percent, about 1.5 to about 2.6 weight percent magnesium, about 0.08 to about 0.15 weight percent zirconium, or about 0.3 to about 0.8 weight percent manganese, in one example.

In accordance with yet another embodiment of the present invention, a method of making the alloy is provided, the method comprising providing a molten body including about 1 to about 3 weight percent magnesium, about 4 to about 10 weight percent zinc, more than about 80 weight percent aluminum and incidental elements, and no copper. The method further includes casting the molten body to provide a solidified body, homogenizing the solidified body to provide a homogenized body, and forming the homogenized body into a wrought product.

In accordance with yet another embodiment of the present invention, a method of producing a copper free aluminum alloy wrought product is provided, the method comprising providing a molten body of an aluminum base alloy comprised of about 0.01 to about 1.5 weight percent silver; about 1.0 to about 3.0 weight percent magnesium; about 4.0 to about 10.0 weight percent zinc; about 0.05 to about 0.25 weight percent zirconium; a maximum of 0.15 weight percent iron; a maximum of 0.15 weight percent silicon; and a remainder including aluminum, incidental elements, and impurities. The method further includes casting the molten body of the aluminum base alloy to provide a solidified body, the molten aluminum base alloy being cast at a rate in the range of about 1 to about 6 inches per minute; homogenizing the solidified body; extruding, rolling or forging the solidified body to produce a wrought product having at least 80% of the cross sectional area of the wrought product in a non-recrystallized condition; solution heat treating the wrought product; cold working the wrought product; and artificially aging the wrought product to provide a wrought product with improved strength, corrosion resistance, fracture toughness, and/or electrical conductivity.

In the method as described above, the extruding may be carried out at a rate in the range of about 0.5 to about 8.0 feet/minute, the homogenizing may be carried out in a temperature range of about 860° F. to about 1010° F. for about 12 to about 48 hours, the solution heat treating may be carried out in a temperature range of about 870° F. to about 900° F. for about 5 to about 120 minutes, the cold working may be applied by cold rolling 0% to 22%, the cold working may be applied by stretching between 0.5% and 5% permanent stretch, or the cold working may be applied by cold compressing between 0.2% and 3.5%, in one example.

In the method as described above, the aging may be carried out in a temperature range between about 175° F. to about 350° F. for about 4 to about 24 hours, the aging may be carried out in a two step process where a first aging step is carried out at temperatures between 175° F. to 325° F. for 2 to 24 hours followed by aging at temperatures between 275° F. and 375° F. for 5 minutes to 48 hours, or the aging may be carried out in a three step process where a first aging step is carried out at temperatures between 175° F. to 325° F. for 2 to 24 hours followed by aging at temperatures between 275° F. and 375°

F. for 5 minutes to 48 hours followed by aging at 150° F. to 325° F. for 3 to 48 hours, in one example.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
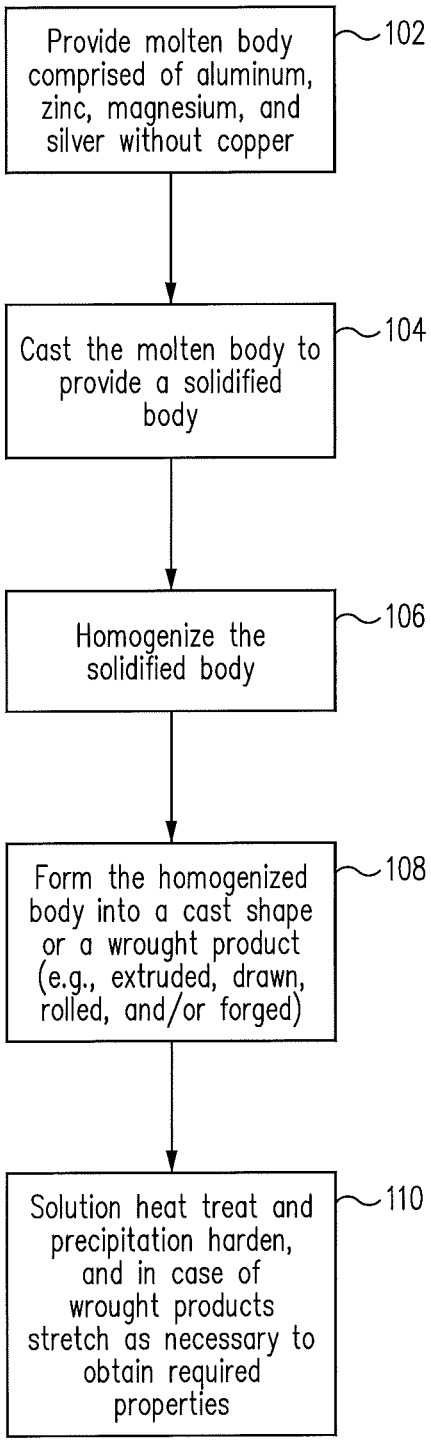
FIG. 1 shows a flowchart illustrating a method of making a metal alloy in accordance with an embodiment of the present invention.

FIG. 1 shows a flowchart illustrating a method for making an advantageous metal alloy in accordance with an embodiment of the present invention.

Step 102 comprises providing a molten body including about 1 to about 3 weight percent magnesium, about 4 to about 10 weight percent zinc, more than about 80 weight percent aluminum, and no copper. In another embodiment, the molten body includes about 0.01 to about 1.5 weight percent silver (e.g., adding silver to 7xxx type alloys). Advantageously, copper is completely removed and the molten body includes silver in this embodiment, thereby improving conductivity, fatigue, fracture toughness, and anti-corrosion properties of the alloy.

The molten body may further include about 0.05 to about 0.25 weight percent zirconium, about 0.05 to about 0.25 weight percent chromium, about 0.01 to about 0.8 weight percent manganese, at most about 0.15 weight percent silicon, and/or at most about 0.15 weight percent iron. Incidental elements and impurities may also be included. For example, scandium may be added between about 0.01 to about 0.25 weight percent, and strontium may be added between about 0.01 to about 0.25 weight percent.

The casting operation is performed such that the hydrogen concentration into the molten body right before casting is maintained below about 15 cc/100 g as determined via Alscan technique or about 0.12 cc/100 g as determined by Telegas.

Step 104 includes casting the molten body to provide a solidified body. Starting ingots may be cast with traditional direct chill methods currently employed for more traditional alloys using practices developed for commercial production of this alloy system. The alloy may also be cast to provide a finished or semi finished part.

Step 106 includes homogenizing the solidified body at sufficient time and temperature to provide a homogenized body that upon proper thermomechanical processing provides uniform and consistent properties through the final product. Preferably the homogenization process consists of a single or multiple step process. More preferably the homogenization will consist of a first homogenization step carried out at temperatures between about 800° F. and about 880° F. followed by a second homogenization step carried out at temperatures between about 880° F. and about 1200° F.

Step 108 includes forming the homogenized body into a wrought product, such as by extrusion, rolling, or forging. In one example, an extrusion process is carried out at a temperature between about 600° F. and about 800° F. and at a rate sufficient to maintain at least 80% of an extrusion in a non-recrystallized condition.

Step 110 includes solution heat treating and/or artificially aging the product at sufficient times and temperature to develop required physical and mechanical properties. For example, solution heat treatment may be accomplished in single or multiple temperature steps between about 800° F. and about 1000° F. The solution heat treatment can be carried out in a single step process where the metal is heated directly at the preferred soaking temperature of about 800° F. to about 1000° F. Additionally, the solution heat treatment can be carried out using a two step process where in a first step the metal is heated up to temperatures between about 860° F. and about $880^2$F for between about 5 minutes and about 180 minutes, followed by a second step carried out at temperatures between about 880° F. and about 1000° F. for between about 10 minutes and about 240 minutes.

Artificial aging may be accomplished in single or multiple steps temperature steps between about 200° F. and about 400° F. to provide the required mechanical, corrosion, and electrical conductivity properties. Additionally, all or part of the aging process may be integrated into thermal practices of other assembly fabrication thermal processes.

Thus, an alloy comprising about 1 to about 3 weight percent magnesium, about 4 to about 10 weight percent zinc, more than about 80 weight percent aluminum, and no copper is provided.

The alloy may further include about 0.05 to about 0.25 weight percent zirconium, about 0.05 to about 0.25 weight percent chromium, about 0.01 to about 0.8 weight percent manganese, at most about 0.15 weight percent silicon, at most about 0.15 weight percent iron, and/or about 0.01 to about 1.5 weight percent silver. Additions of minor amounts of elements such as scandium or strontium may be added.

Advantageously, the alloy of the present invention has improved strength properties, improved fracture toughness, exfoliation corrosion rating of EA or better in peak strength temper, high electrical conductivity, improved conductivity to density ratio, and good galvanic corrosion behavior when attached to a carbon fiber (e.g., graphite) composite member. When used for an aircraft, the present invention advantageously aids in lowering the weight of the aircraft and/or increasing in-service inspection intervals.

The present invention may be utilized in a variety of applications, including but not limited to manufacturing aircraft parts, armor plating, off shore drilling pipes, and cast parts.

Product Properties

Traditional 7xxx aluminum alloys contain major additions of zinc, along with magnesium or magnesium plus copper in combinations that develop various levels of strength. The 7xxx alloys containing copper as an alloying element are capable of developing high levels of strength. For a constant percentage of zinc and magnesium, the strength that these Al—Zn—Mg—Cu alloys can develop is directly proportional to the amount of copper. The lower the copper content, the lower the strength. Additionally, the existence of copper adversely impacts the general corrosion and crevice corrosion behavior of 7xxx alloys, as noted in L. F. Mondolfo, Aluminum Alloys: Structure and Properties, Butterworths, 1976, p 851.

Figure 2:
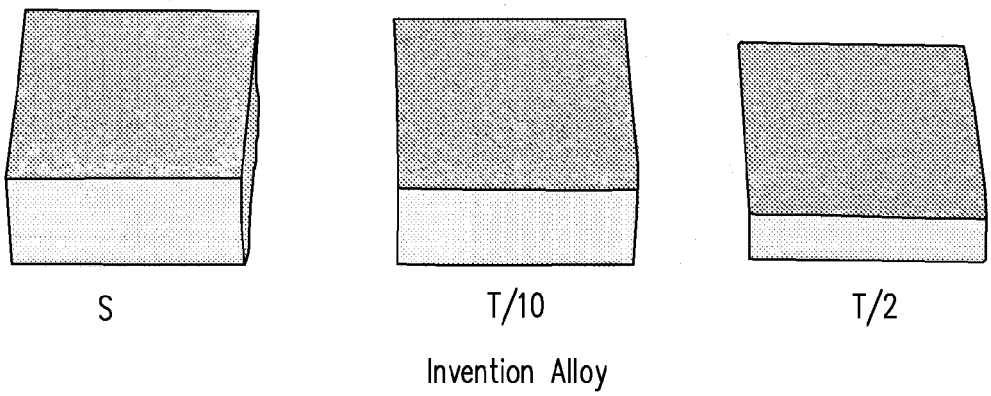
FIGS. 2 and 3 show the exfoliation corrosion behavior of the invention alloy in comparison to an Al—Zn—Mg—Cu alloy, respectively, in accordance with an embodiment of the present invention.
Figure 3:
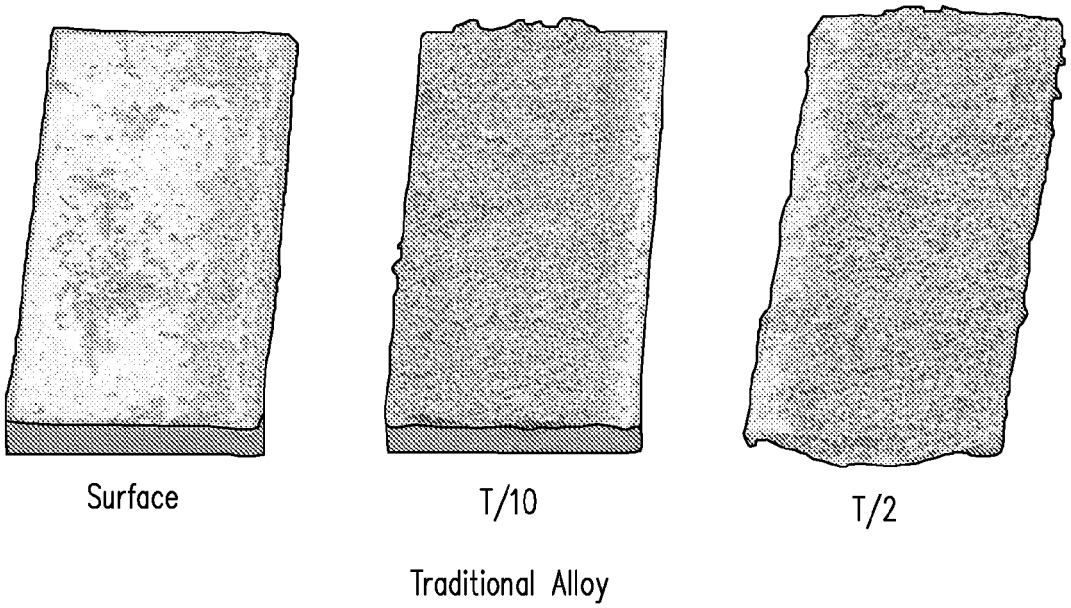

Referring now to FIGS. 2 and 3, the present invention advantageously uses silver additions to a copper-free 7xxx alloy to achieve high strengths and excellent general and exfoliation corrosion behavior. The silver additions improve the otherwise low strength of a copper-free 7xxx alloy while not detrimentally impacting the corrosion resistance. FIGS. 2 and 3 depict the exfoliation corrosion behavior of the invention alloy in comparison to an Al—Zn—Mg—Cu alloy of identical strength, respectively, with substantially reduced exfoliation corrosion being shown on the invention alloy.

Figure 4:
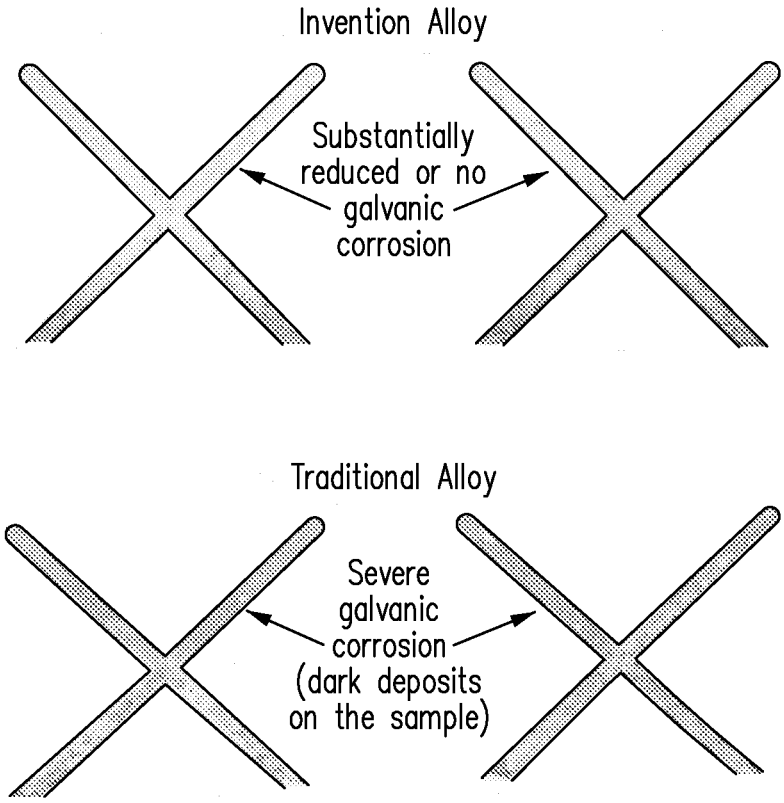
FIG. 4 shows a comparison of galvanic corrosion resistance between a traditional alloy and a metal alloy in accordance with an embodiment of the present invention.

Referring now to FIG. 4, the invention alloy exhibits excellent galvanic corrosion resistance when coupled to a carbon fiber composite member. The galvanic corrosion resistance of the invention alloy far surpasses that of an Al—Zn—Mg—Cu alloy. FIG. 4 depicts the galvanic corrosion resistance of the invention alloy in comparison to that of an Al—Zn—Mg—Cu alloy of equivalent strength, with substantially reduced galvanic corrosion being shown on the invention alloy by the reduced dark deposits as compared to the traditional alloy.

Additionally, it is common knowledge that the peak strength of a traditional 7xxx aluminum alloy increases with an increase in the weight percentage of alloying elements like Zn, Cu, Mg. It is also common knowledge that the increase in the weight percentage of alloying elements used will determine a decrease in the fracture toughness of the alloy.

Figure 5:
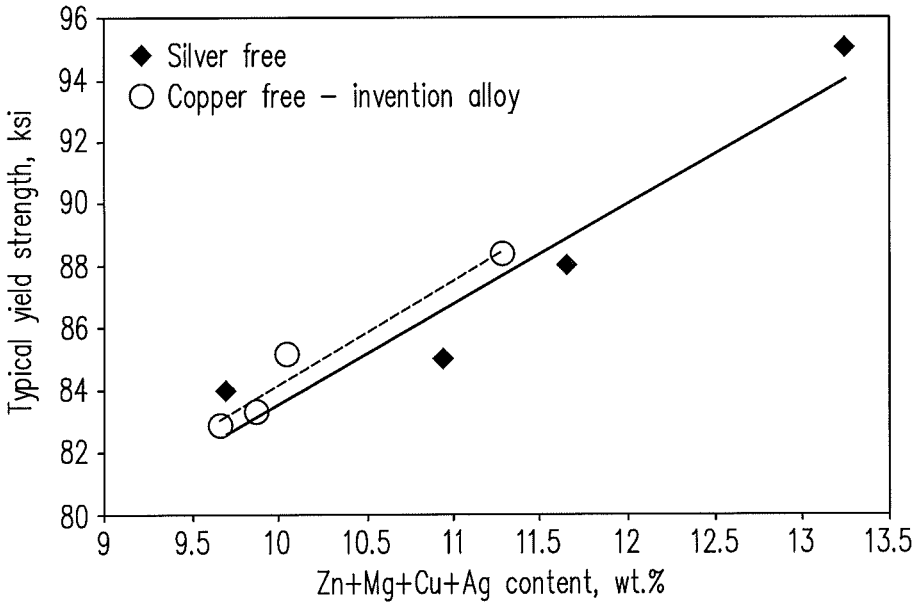
FIG. 5 is a graph comparing the variation of peak yield strength with total weight percentage of alloying elements between several common 7xxx alloys and that of the invention alloy in accordance with an embodiment of the present invention.

FIG. 5 depicts the variation of peak yield strength with total weight percentage of alloying elements like zinc, magnesium, copper, and silver of several common 7xxx alloys and that of the invention alloy. As seen in FIG. 5 the peak yield strength of the common alloys is increasing with an increase in the weight percentage of the constitutive alloying elements. Furthermore, the invention alloys as well as the traditional alloys show substantially identical behavior; i.e., for similar percentages of alloying elements the invention alloy and the traditional copper containing 7xxx alloys show nearly identical strength values.

Figure 6:
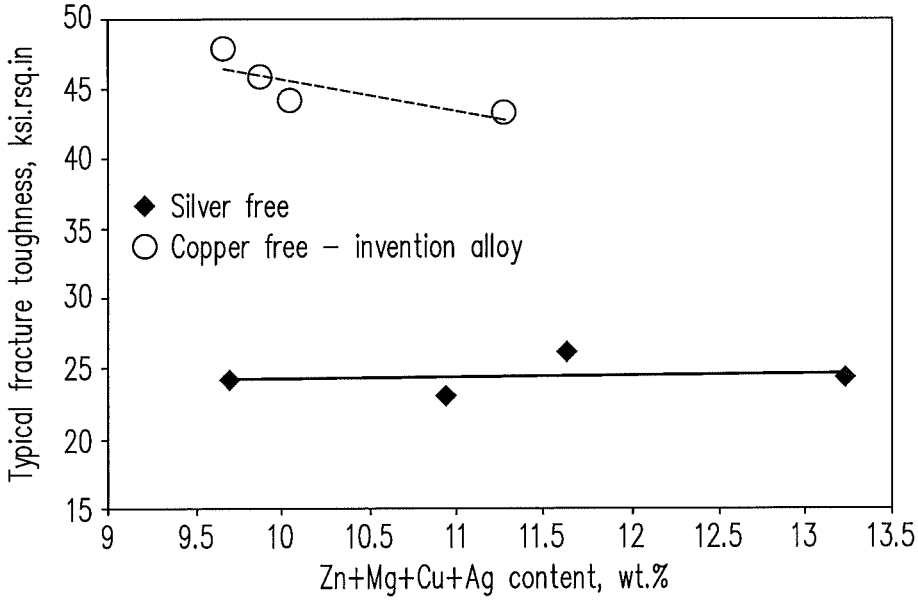
FIG. 6 is a graph comparing the dependency of fracture toughness with total weight percentage of alloying elements between several common 7xxx alloys and that of the invention alloy in accordance with an embodiment of the present invention.

However, the invention alloy has a very different behavior with respect to fracture toughness when compared to traditional alloys. Referring to FIG. 6, for the same alloys depicted in FIG. 5, the dependency between fracture toughness and the percentage of constitutive alloying elements is shown. As can be seen, for the same total weight percentage of alloying elements, the invention alloy exhibits much higher fracture toughness than the traditional copper containing 7xxx alloys.

Figure 7:
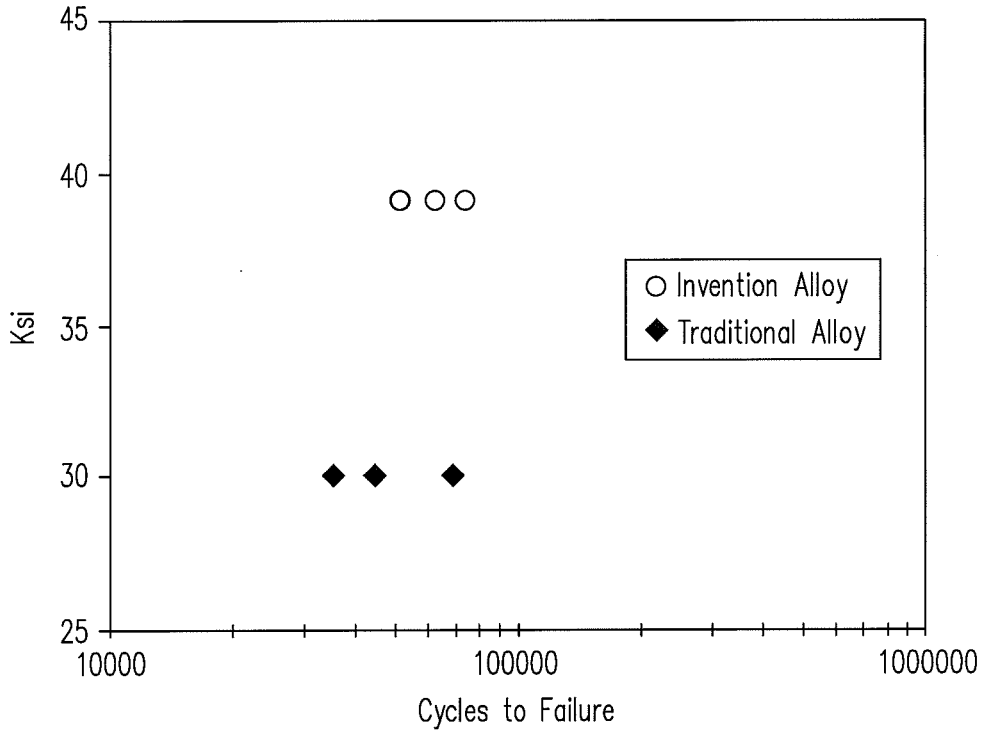
FIG. 7 is a graph comparing fatigue performance between a traditional alloy and a copper-free alloy of the present invention.

Furthermore, when compared to traditional alloys of equivalent strength the invention alloy exhibits improved fatigue performance over the traditional alloy, as demonstrated by similar fatigue lives as traditional alloys but at a higher test stress level as shown in FIG. 7.

Figure 8:
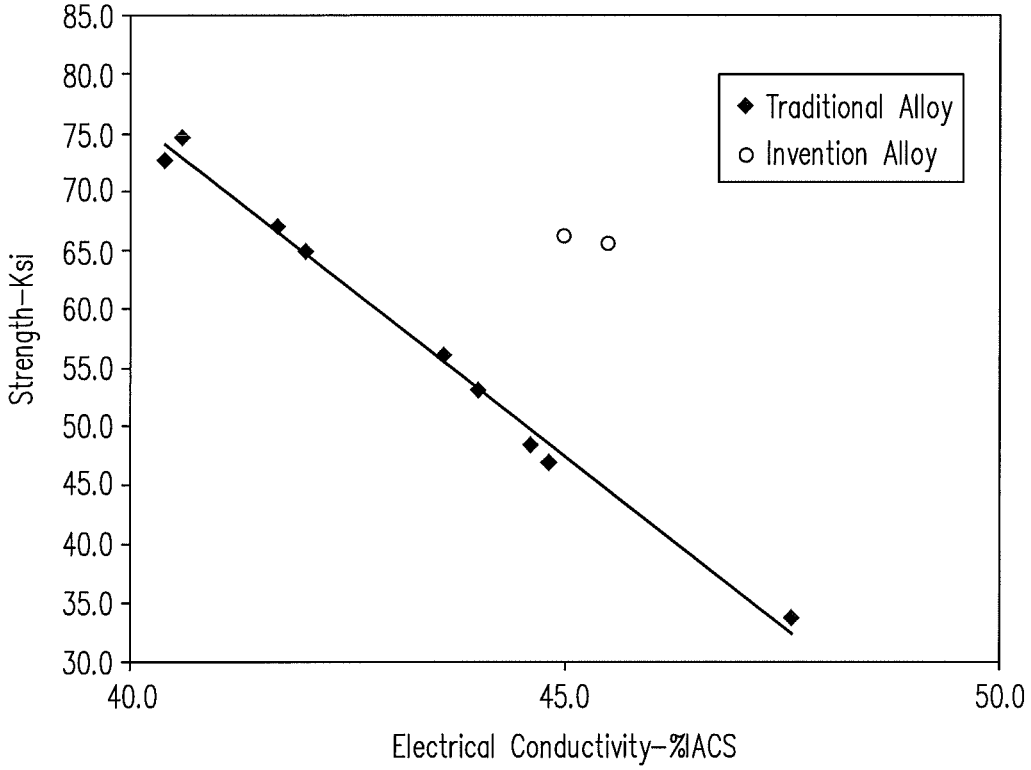
FIG. 8 is a graph comparing a relationship of strength and electrical conductivity between a traditional alloy and a copper-free alloy of the present invention.

The differences in the invention alloy and traditional copper-containing 7000 series are further supported by the strength-conductivity relationship shown in FIG. 8, which demonstrates that the invention alloy provides higher strength at higher conductivities than traditional alloys.

Figure 9:
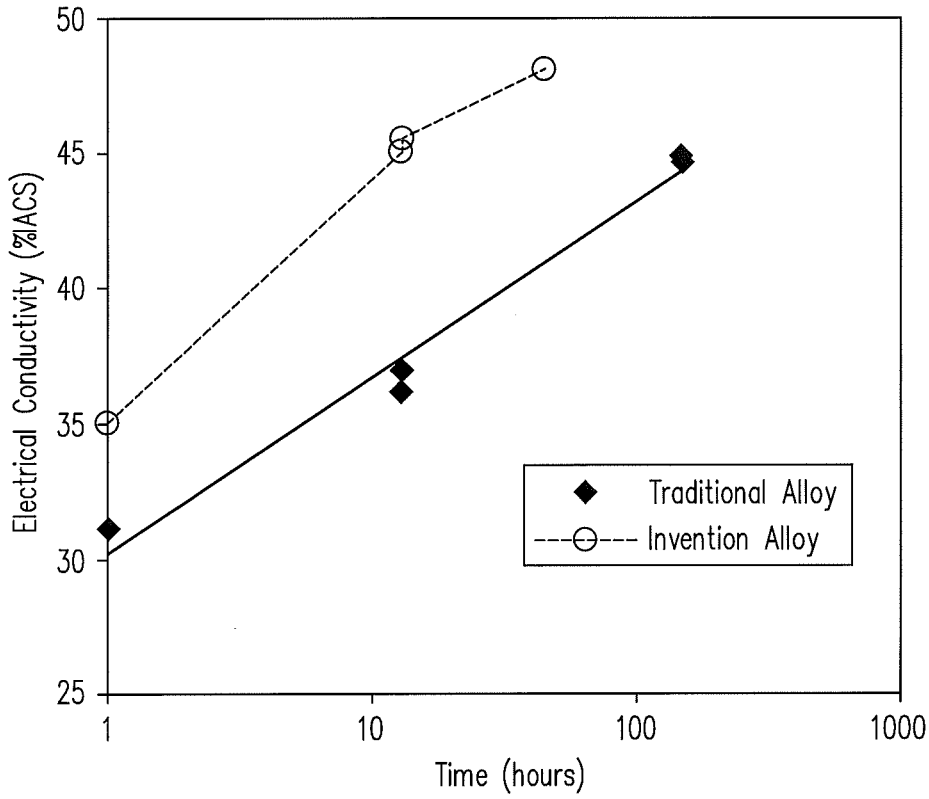
FIG. 9 is a graph comparing a relationship of electrical conductivity and time between a traditional alloy and a copper-free alloy of the present invention.

Additionally, the time required to obtain high electrical conductivity for a particular strength level is much shorter than that required for a traditional 7000 series alloy as shown in FIG. 9.

Embodiments described above illustrate but do not limit the invention. It should also be understood that numerous modifications and variations are possible in accordance with the principles of the present invention. Accordingly, the scope of the invention is defined only by the following claims.

We claim:

1. A method of producing a copper-free aluminum alloy wrought product, the method comprising:

(a) providing a molten body of an aluminum base alloy comprised of about 0.01 to about 1.5 weight percent silver; about 1.0 to about 3.0 weight percent magnesium; about 4.0 to about 10.0 weight percent zinc; about 0.05 to about 0.25 weight percent zirconium; a maximum of 0.15 weight percent iron; a maximum of 0.15 weight percent silicon; and a remainder including aluminum, incidental elements, and impurities, wherein the remainder does not include copper and scandium, and wherein a sum of the zinc and the magnesium and the silver in the molten body ranges from about 9.5 weight percent to about 11.5 weight percent;

(b) casting the molten body of the aluminum base alloy to provide a solidified body;

(c) homogenizing the solidified body;

(d) extruding, rolling or forging the solidified body to produce a wrought product;

(e) solution heat treating the wrought product in a temperature range of about 870° F. to about 900° F. for about 5 to about 120 minutes;

(f) cold working the wrought product, wherein the cold working comprises cold rolling 0% to 22% or cold compressing between 0.2% and 3.5%; and (g) artificially aging the wrought product, wherein the solidified body and the wrought product are not heat treated above 932° F., and wherein a fracture toughness for the aged wrought body is at least 40 ksi square root inch, and wherein an exfoliation corrosions resistance for the aged wrought body is ASTM rating EA or better, and wherein an electrical conductivity for the aged wrought body is at least 45% ACS.

2. The method in accordance with claim 1, wherein the extruding is carried out at a rate in the range of about 0.5 to about 8.0 feet/minute.

3. The method in accordance with claim 1, wherein the aging is carried out in one of three processes selected from the group consisting of a one step process where a temperature range is between about 175° F. to about 350° F. for about 4 to about 24 hours, a two step process where a first aging step is carried out at temperatures between 175° F. to 325° F. for 2 to 24 hours followed by aging at temperatures between 275° F. and 375° F. for 5 minutes to 48 hours, and a three step process where a first aging step is carried out at temperatures between 175° F. to 325° F. for 2 to 24 hours followed by aging at temperatures between 275° F. and 375° F. for 5 minutes to 48 hours followed by aging at 150° F. to 325° F. for 3 to 48 hours.

4. The method in accordance with claim 1, further comprising casting the molten body at a rate in the range of about 1 to about 6 inches per minute.

5. The method in accordance with claim 1, wherein the extruding, rolling or forging of the solidified body is carried out to produce a wrought product having at least 80% of the cross sectional area of the wrought product in a non-recrystallized condition.

* * * * *